US010820689B2

(12) United States Patent
Liu

(10) Patent No.: US 10,820,689 B2
(45) Date of Patent: Nov. 3, 2020

(54) ADJUSTABLE LIFTING SUPPORT DEVICE

(71) Applicant: CHEN-SOURCE INC., Taoyuan (TW)

(72) Inventor: Chang-Li Liu, Taoyuan (TW)

(73) Assignee: CHEN-SOURCE INC., Taoyuan (TW)

( * ) Notice: Subject to any disclaimer, the term of this patent is extended or adjusted under 35 U.S.C. 154(b) by 118 days.

(21) Appl. No.: 16/191,837

(22) Filed: Nov. 15, 2018

(65) Prior Publication Data

US 2020/0154878 A1 May 21, 2020

(51) Int. Cl.
*A47B 9/06* (2006.01)

(52) U.S. Cl.
CPC ..... *A47B 9/06* (2013.01)

(58) Field of Classification Search
CPC .. A47C 7/541; A47C 1/03; A47B 9/06; A47B 9/20; A47B 2009/003; A47B 21/02; A47B 23/00; A47B 13/023; A47B 17/02
USPC ..... 297/411.36; 248/188.2, 407, 408, 354.7, 248/161, 404; 108/146, 147, 50.01, 50.02
See application file for complete search history.

(56) References Cited

U.S. PATENT DOCUMENTS 2,016,132 A * 10/1935 Bergslien ..... A47C 3/26 248/409
2,520,450 A * 8/1950 Austin, Jr. ..... A45F 3/44 248/125.1
3,126,071 A * 3/1964 Basset ..... A63B 22/0605 472/2
3,224,595 A * 12/1965 Sherley ..... B65F 1/1421 211/83
3,443,784 A * 5/1969 Walkinshaw ..... A47C 3/26 248/408
4,235,405 A * 11/1980 Carey ..... F16M 11/105 248/123.11
4,496,190 A * 1/1985 Barley ..... B60N 2/767 297/411.38
4,706,915 A * 11/1987 Cindric ..... A63H 3/50 248/125.8
5,382,079 A * 1/1995 Wilson ..... A47C 1/03 297/411.35
6,857,378 B2 * 2/2005 Franze ..... A47B 9/06 108/146
6,938,869 B2 * 9/2005 Lin ..... F16M 11/28 248/161

(Continued)

FOREIGN PATENT DOCUMENTS

WO 2017200488 * 11/2017

*Primary Examiner* — Janet M Wilkens
(74) *Attorney, Agent, or Firm* — Muncy, Geissler, Olds and Lowe, P.C.

(57) ABSTRACT

An adjustable lifting support device is disclosed. The adjustable lifting support device includes a base, a lifting rod and an adjusting device. The base includes a placing plate and a connecting part disposed on the placing plate. The lifting rod includes a rod disposed on the connecting part and including teeth arranged longitudinally. The adjusting device includes a connecting holder mounted on the rod, and the bottom of the connecting holder is pivotally connected to an engaging member which is jointed with a linking device. The placing plate can be placed on desktop and a support plate disposed on the connecting part can be adjusted in position. The linking device can be used to drive the engaging member to engage with or separate from the teeth of the lifting rod, so that the connecting holder can be slidably lifted and locked on the rod of the lifting rod.

11 Claims, 7 Drawing Sheets

(56) References Cited

U.S. PATENT DOCUMENTS

| | | | | |
|---|---|---|---|---|
| 7,364,535 | B1 * | 4/2008 | Rosenow | A63B 21/4033 482/101 |
| 8,960,104 | B2 * | 2/2015 | Copeland | A47B 3/00 108/117 |
| 9,707,436 | B1 * | 7/2017 | Atwood | A63B 21/063 |
| 10,631,629 | B2 * | 4/2020 | Hung | A47B 7/02 |
| 2006/0166792 | A1 * | 7/2006 | Kuo | A63B 22/0605 482/57 |
| 2007/0215781 | A1 * | 9/2007 | Watt | B62K 19/36 248/622 |
| 2009/0095857 | A1 * | 4/2009 | Su | F16M 11/10 248/188.5 |
| 2010/0303603 | A1 * | 12/2010 | Galante | B62B 3/02 414/811 |
| 2011/0068235 | A1 * | 3/2011 | Patterson | A47G 29/1216 248/125.1 |
| 2012/0248263 | A1 * | 10/2012 | Grotenhuis | A47B 21/02 248/123.2 |
| 2013/0126682 | A1 * | 5/2013 | Tholkes | A47B 21/0314 248/125.8 |
| 2014/0104806 | A1 * | 4/2014 | Segar | F16M 11/42 361/809 |
| 2018/0228279 | A1 * | 8/2018 | Guzman | A47B 13/12 |

* cited by examiner

ADJUSTABLE LIFTING SUPPORT DEVICE

BACKGROUND OF THE INVENTION

1. Field of the Invention

The present invention generally relates to an adjustable lifting support device. More particularly, a placing plate of a base of the adjustable lifting support device can be placed in a desired position, and the adjustable lifting support device includes an adjusting device which can use a linking device to drive an engaging member to engage with or separate from a plurality of teeth of a lifting rod, so that a connecting holder of the adjusting device can be slidably lifted and locked on the rod of the lifting rod; as a result, a user can adjust the height of the connecting holder according to a view angle thereof, thereby reducing burden of the user's shoulder and neck.

2. Description of the Related Art

Generally, because of having characteristics of small size, light weight, and easy carrying, portable electronic devices such as notebook computers or tablet computer, are popular and applied in many workplaces. However, operations of the notebooks or tablet computers are also limited by sizes and structures thereof, and most notebook or tablet computers are less ergonomic in operations. For example, the user's view angle to a screen of notebook or tablet computer is lower, so that the user may have burden on or injury in shoulder and neck thereof after using the notebook or tablet computer for a long time. For this reason, some manufacturers develop support frames for notebook computers or tablet computers to increase the height of viewing the screens, so as to relieve burden on the shoulder and neck of the user.

Most of conventional support frames available in the market are fixed-type support frames that cannot be adjusted in height, and the user's view angle is also limited by the fixed-type support frame that cannot adjust the height thereof; however, different users have different heights and focal lengths, and may feel comfortable in different viewing angles, so the conventional fixed-type support frame cannot properly and accurately meet the user's requirement in view angle, and thus cannot effectively relieve the burden on the user's shoulder and neck.

Therefore, what is needed is to develop an adjustable lifting support device to solve the above-mentioned problems.

SUMMARY OF THE INVENTION

In order to solve conventional problems, the inventor develops an adjustable lifting support device according to collected data, multiple tests and modifications, and years of experience in the industry.

An objective of the present invention is that a base of the adjustable lifting support device comprises a connecting part disposed on a surface of a placing plate thereof, and a lifting rod of the adjustable lifting support device comprises a rod disposed on the connecting part, and the rod comprises a plurality of teeth arranged longitudinally on a surface of a side thereof, and an adjusting device of the adjustable lifting support device comprises a connecting holder mounted on the rod, and the bottom of the connecting holder is pivotally connected to the engaging member, and the engaging member is jointed with a linking device; and, the placing plate of the base can be placed on desktop of a desk, an office desk or a meeting table, and the connecting holder can be adjusted in position according to the focal length and comfort of the user eye; and, the adjusting device can use the linking device to drive the engaging member of the adjusting device to engage with or separate from the plurality of teeth of the lifting rod, so that the connecting holder of the adjusting device can be slidably lifted along and locked on the rod of the lifting rod, thereby accurately adjusting the height of the connecting holder according to the view angle of the user, to reduce burden on or injury in the user's shoulder and neck caused by incorrect posture.

An objective of the present disclosure is that, after the rod of the lifting rod is fixed on the connecting part of the base, a support surface of a back side of the combination groove of the combination holder is inclined, and a back side of the rod can be abutted against the inclined support surface, so that the rod is inclined during assembly, and when the connecting holder of the adjusting device is slidably lifted along the rod, the rod of the inclined lifting rod can provided resistance to prevent the connecting holder of the adjusting device from falling directly and quickly. As a result, the user can lift and move the connecting holder effortlessly, and the simple, time saving and effortless operation can be achieved.

Another objective of the present invention is that the elastic function of the elastic element can be used to improve the engagement force of the engaging member of the adjusting device engaged with the plurality of teeth of the lifting rod, so as to prevent the engaging member from being separated from the plurality of teeth easily; and, the elastic function of the elastic element can also facilitate the user to operate the linking device of the adjusting device by single hand, thereby achieving the purpose of improving engagement intensity and providing simple and convenient operation.

BRIEF DESCRIPTION OF THE DRAWINGS

The structure, operating principle and effects of the present invention will be described in detail by way of various embodiments which are illustrated in the accompanying drawings.

DETAILED DESCRIPTION OF THE PREFERRED EMBODIMENTS

Figure 1:
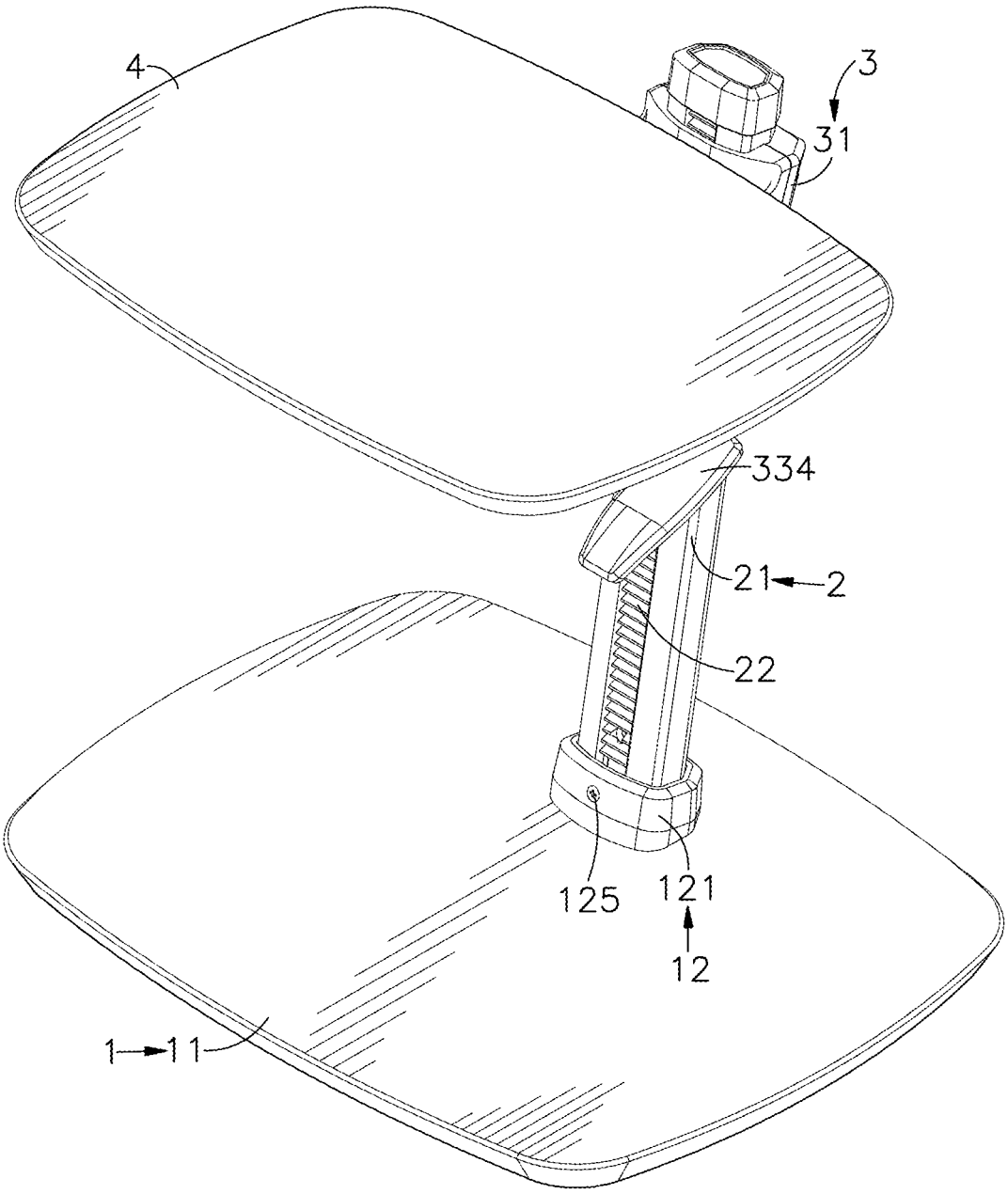
FIG. 1 is an exploded view of an adjustable lifting support device of the present invention.

The following embodiments of the present invention are herein described in detail with reference to the accompanying drawings. These drawings show specific examples of the embodiments of the present invention. It is to be understood that these embodiments are exemplary implementations and are not to be construed as limiting the scope of the present invention in any way. Further modifications to the disclosed embodiments, as well as other embodiments, are also included within the scope of the appended claims. These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts.

It is to be understood that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present disclosure. As used herein, the term "or" includes any and all combinations of one or more of the associated listed items.

It will be understood that when an element or layer is referred to as being "on," "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present.

In addition, unless explicitly described to the contrary, the word "comprise" and variations such as "comprises" or "comprising", will be understood to imply the inclusion of stated elements but not the exclusion of any other elements.

Figure 2:
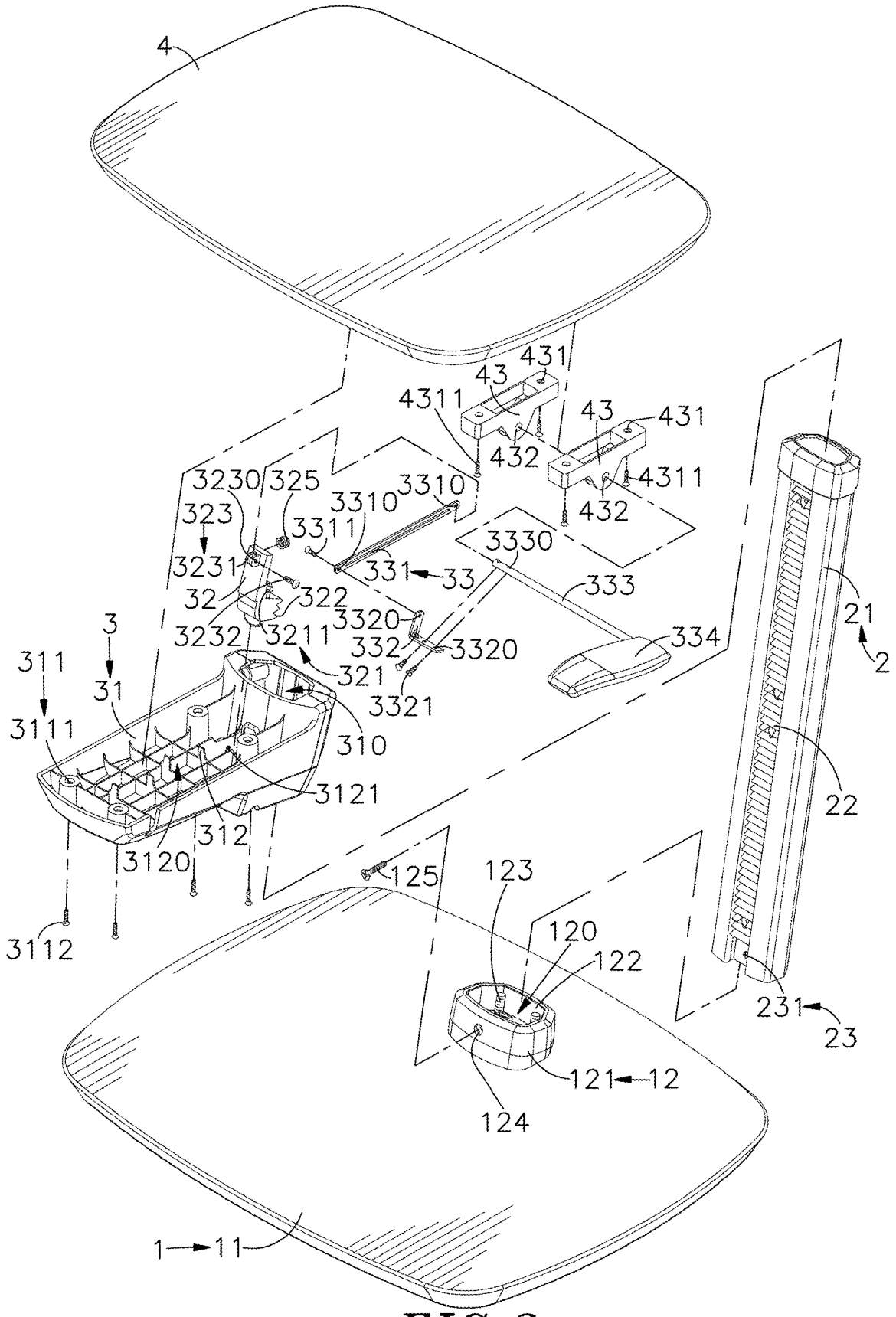
FIG. 2 is an exploded view of an adjustable lifting support device of the present invention.
Figure 3:
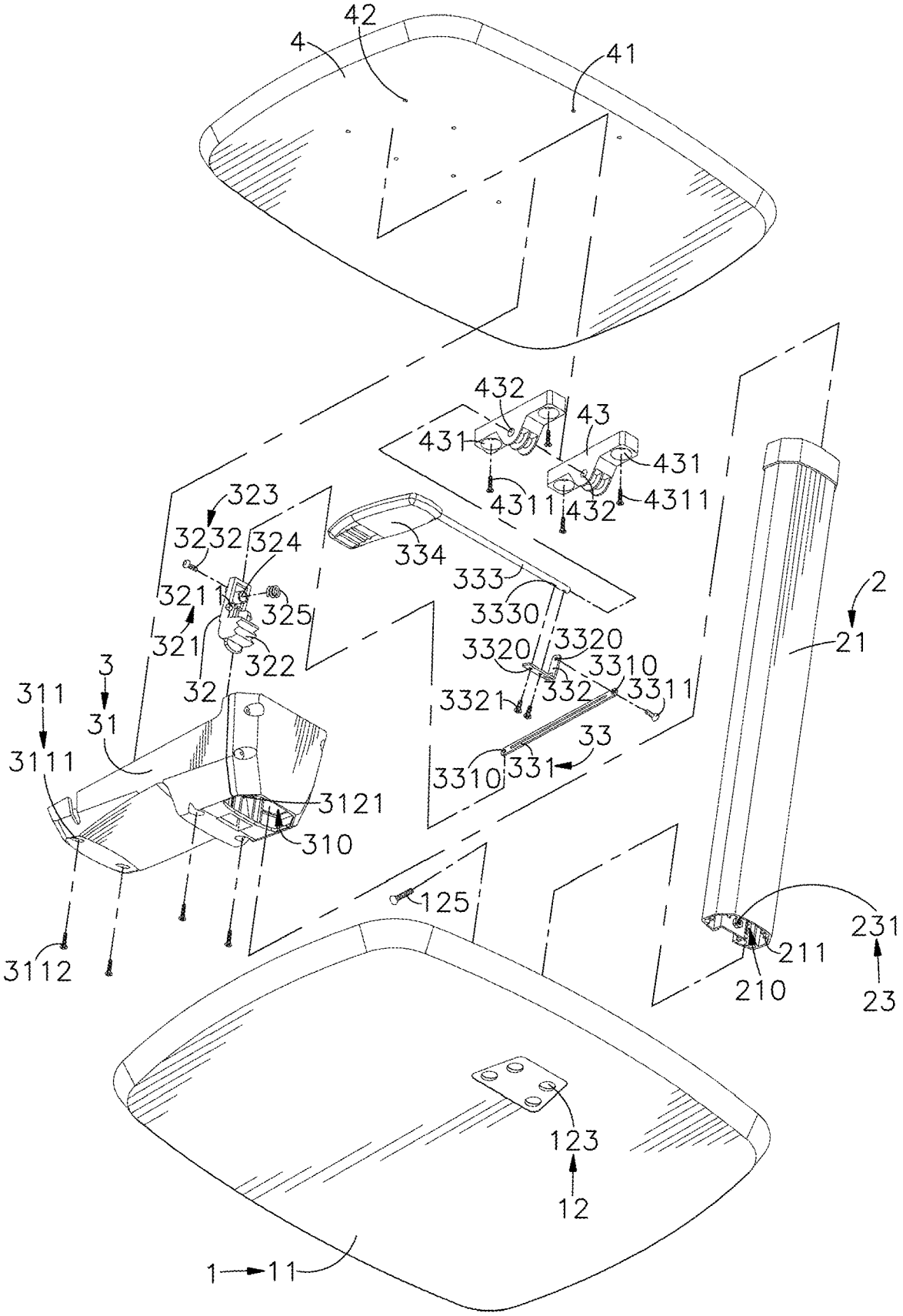
FIG. 3 is an exploded view of an adjustable lifting support device of the present invention, when viewed from another angle.
Figure 4:
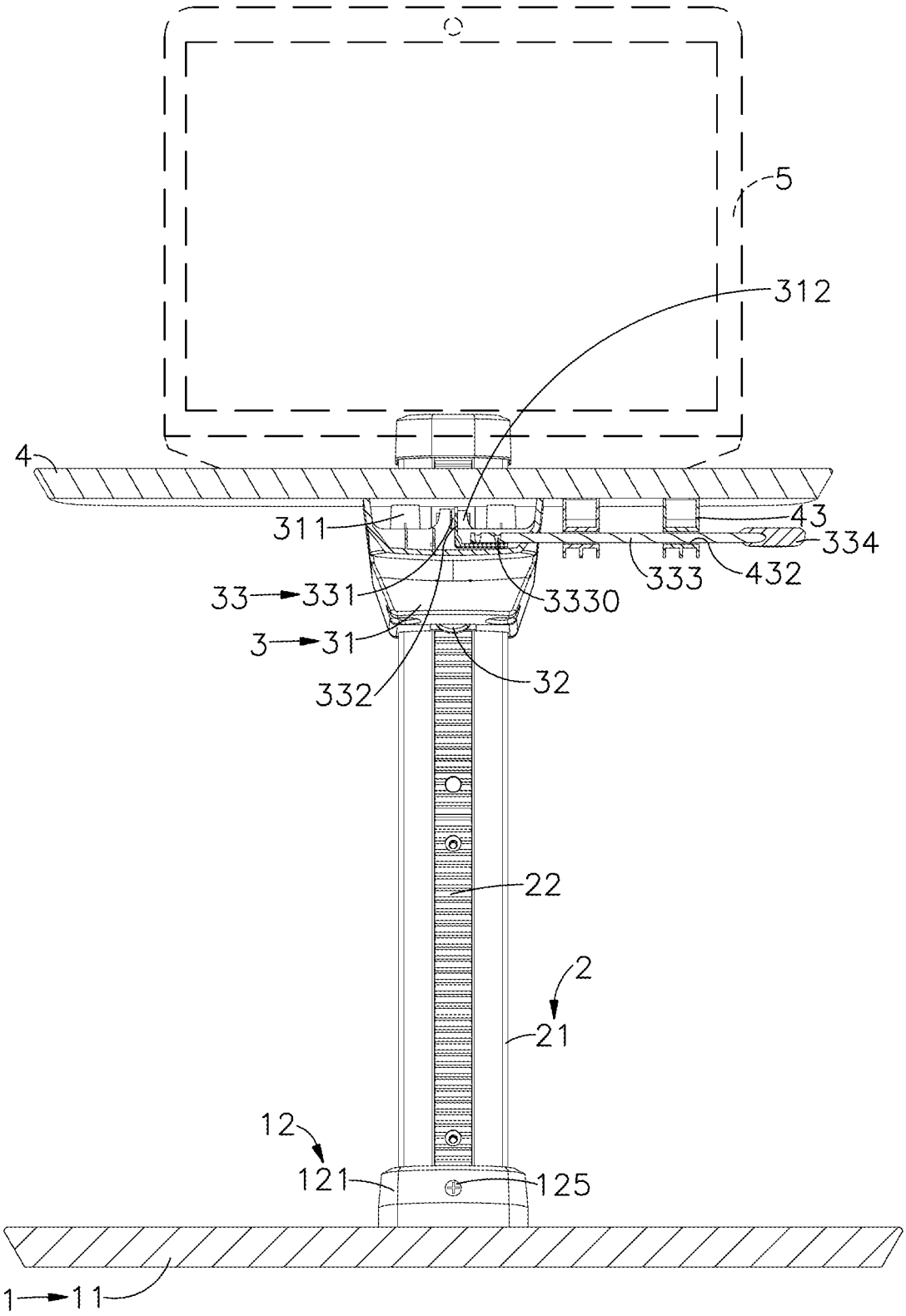
FIG. 4 is a front view of an adjustable lifting support device of the present invention, when the adjustable lifting support device is in use.
Figure 5:
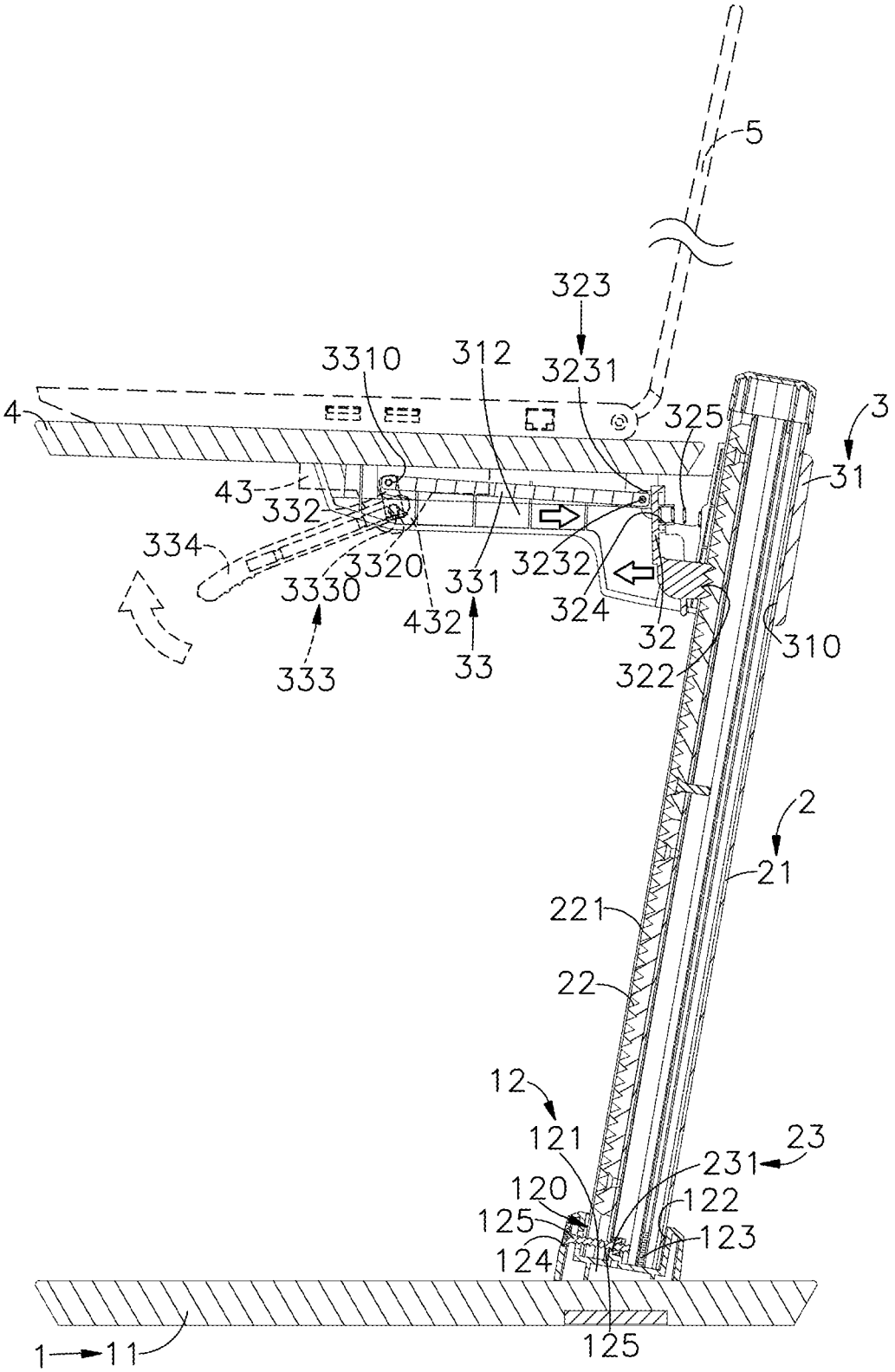
FIG. 5 is a first sectional side view of an adjustable lifting support device of the present invention, when the adjustable lifting support device is in use.
Figure 6:
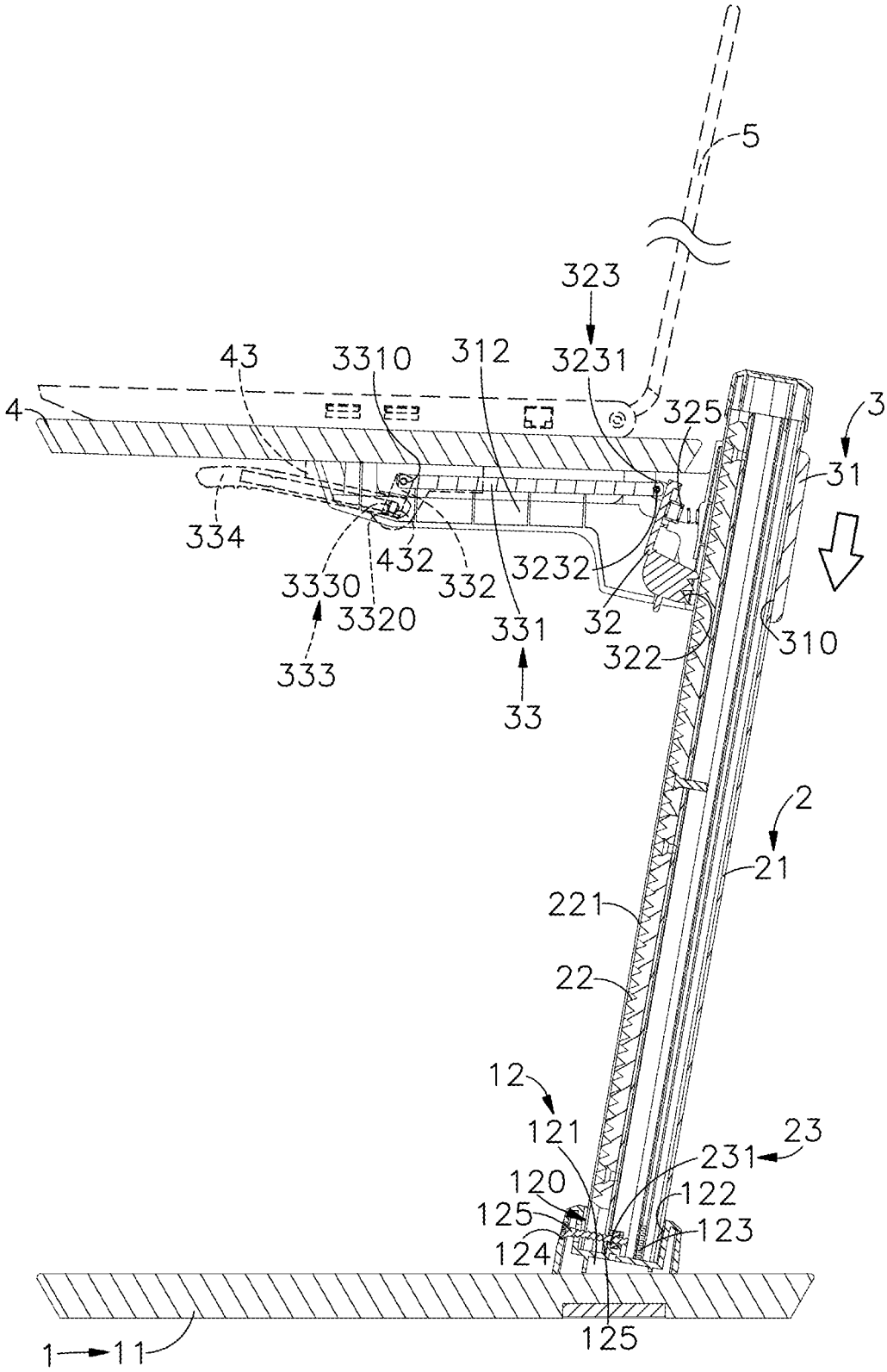
FIG. 6 is a second sectional side view of an adjustable lifting support device of the present invention, when the adjustable lifting support device is in use.
Figure 7:
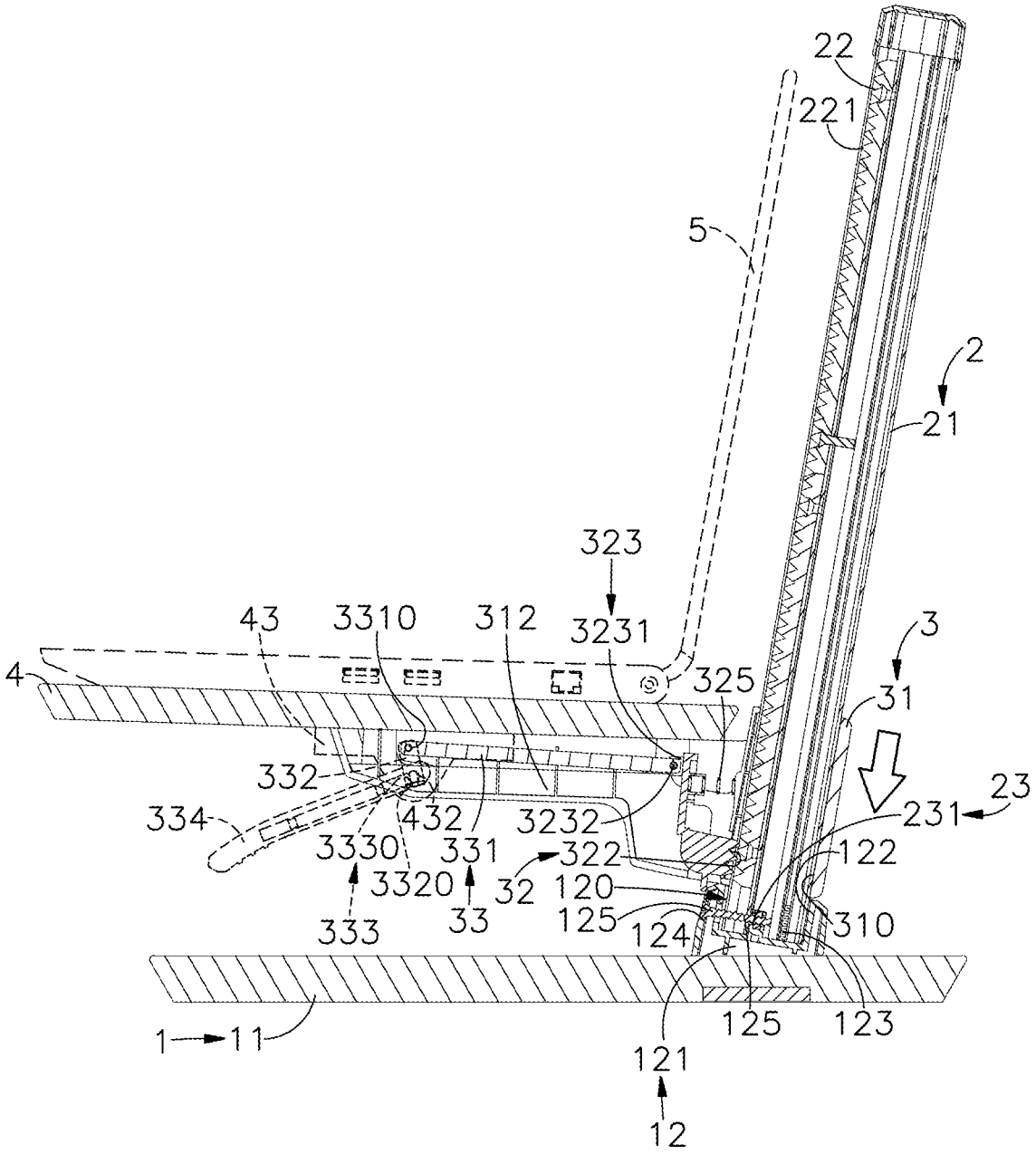
FIG. 7 is a third sectional side view of an adjustable lifting support device of the present invention, when the adjustable lifting support device is in use.

Please refer to FIGS. 1 to 3, which are elevational view of an adjustable lifting support device of the present invention, exploded view of an adjustable lifting support device of the present invention, and other exploded view of an adjustable lifting support device of the present invention when viewed from another angle. The adjustable lifting support device comprises a base 1, a lifting rod 2 and an adjusting device 3.

The base 1 comprises a flat placing plate 11, and a connecting part 12 disposed on a surface of the placing plate 11. The connecting part 12 includes a combination holder 121 protruded on a surface of the placing plate 11, and the combination holder 121 includes a combination groove 120 recessed inside thereof, and the combination groove 120 comprises a support surface 122 formed on a back sidewall thereof and inclined outwardly, and a plurality of restraining pins 123 protruded around a bottom surface thereof, and a through hole 124 formed on a front sidewall thereof. A first fastening element 125 is inserted through the through hole 124.

The lifting rod 2 comprises a rectangular rod 21, and the rod 21 includes an accommodation space 210 formed inside thereof, and a plurality of restraining grooves 211 formed on an inside wall of the accommodation space 210, and a plurality of teeth 22 formed on a side surface of the rod 21 and arranged longitudinally. The lifting rod 2 also includes a positioning part 23 disposed on a bottom thereof, and the positioning part 23 includes a lock hole 231 formed below the plurality of teeth 22 and cut therethrough forwardly.

The adjusting device 3 comprises a connecting holder 31, and the connecting holder 31 includes a sliding hole 310 formed on a side of a surface thereof and cut through longitudinally, and a support part 311 disposed on other side of the surface thereof. The support part 311 includes a plurality of holes 3111 formed on the surface of the connecting holder 31 and cut through thereof. A plurality of second fastening elements 3112 are inserted into the plurality of holes 3111, respectively. The connecting holder 31 includes a plurality of plates 312 disposed inside thereof and arranged in interval, and an accommodating space 3120 is formed between the plurality of plates 312, and each of the plurality of plates 312 includes a pass hole 3121, and the plurality of pass holes 3121 are aligned to each other. The connecting holder 31 is pivotally connected to a shaft part 321 of an engaging member 32. The shaft part 321 includes shafts 3211 disposed at two sides thereof and horizontally pivotally connected to the two pass holes 3121. The engaging member 32 includes an engaging surface 322 protruded backwardly on a side of the shaft part 321, and the engaging member 32 includes an abutting part 323 disposed on other side of the shaft part 321, and the abutting part 323 comprises a plurality of joint plates 3231 protruded forwardly, and each of the plurality of joint plates 3231 includes a joint hole 3230, and a third fastening element 3232 is inserted through in the plurality of joint holes 3230. Furthermore, the abutting part 323 of the engaging member 32 includes an accommodating groove 324 recessed on an opposite side thereof, and an elastic element 325 is accommodated in the accommodating groove 324. Two ends of the elastic element 325 are abutted against the bottom surface of the accommodating groove 324 and a back side wall inside the connecting holder 31.

A joint rod 331 of the linking device 33 is jointed between the plurality of joint plates 3231 of the abutting part 323 and accommodated in the accommodating space 3120. The joint rod 331 comprises first combination holes 3310 cut through two ends thereof, respectively, and the first combination hole 3310 of the end of the joint rod 331 is aligned to the joint hole 3230, and the third fastening element 3232 can be inserted through the first combination hole 3310 and the joint hole 3230 to pivotally connected to the joint rod 331 integrally, and other end of the joint rod 331 is connected to a L-shaped abutting plate 332. The abutting plate 332 comprises second combination holes 3320 formed on two ends thereof, respectively, and the second combination hole 3320 of a longitudinal section of the abutting plate 332 is aligned to one of the first combination holes 3310, and a fourth fastening element 3311 can be inserted through the aligned first combination hole 3310 and the second combination hole 3320 to lock the abutting plate 332 and the joint rod 331 integrally. A horizontal section of the abutting plate 332 is connected to a L-shaped link rod 333, and the link rod 333 comprises third combination holes 3330 cut through an end thereof. The third combination holes 3330 of the link rod 333 are aligned to the second combination holes 3320 of a horizontal section of the abutting plate 332, and a plurality of fifth fastening elements 3321 can be locked in the aligned second combination holes 3320 and the third combination holes 3330, respectively. A rectangular poke plate 334 is mounted on the other end of the link rod 333 opposite to end having the third combination holes 3330.

In order to assemble the adjustable lifting support device of the present invention, the lifting rod 2 is mounted on the connecting part 12 of the base 1, the positioning part 23 at the bottom of the rod 21 of the lifting rod 2 can be inserted into the combination groove 120 of the combination holder 121 of the connecting part 12, and the rear side of the rod 21 can be abutted against the support surface 122 at back side of the combination groove 120, and the plurality of restraining pins 123 of the connecting part 12 can be inserted into the plurality of restraining grooves 211 of the rod 21 to be constrained; at this time, the through hole 124 of the connecting part 12 can be aligned to the lock hole 231 of the positioning part 23, and the first fastening element 125 of the connecting part 12 can be inserted through the through hole 124 and fastened in the lock hole 231 to form stable combination, so that the base 1 and the lifting rod 2 can be assembled integrally. After the base 1 and the lifting rod 2 are assembled together, the connecting holder 31 of the adjusting device 3 can be mounted on the rod 21 of the lifting rod 2, and the rod 21 can pass through the sliding hole 310 of the connecting holder 31, and the engaging member 32 of the adjusting device 3 can be engaged with the plurality of teeth 22 on the front side of the rod 21 by the engaging surface 322 on back side thereof, so that the adjusting device 3 can be stably constrained and positioned on the rod 21 of the lifting rod 2. As a result, the assembly of the adjustable lifting support device of the present invention can be completed.

In an embodiment, the interval between the adjacent two tips 221 of the plurality of teeth 22 is in range of 0.5 cm to 5 cm; and, the preferred interval is 2 cm, so that the adjustable lifting support device can have good precision and engagement intensity.

Please refer to FIGS. 4 to 7, which are front view, first sectional side view, second sectional side view, and third sectional side view of the adjustable lifting support device of the present invention. As shown in FIGS. 4 to 7, in order to use the adjustable lifting support device, the support plate 4 can be mounted on the support part 311 of the connecting holder 31 of the adjusting device 3 first, and the support plate 4 comprises a plurality of first positioning holes 41 recessed on a bottom surface thereof and aligned to the plurality of holes 3111, respectively; and, the plurality of second fastening elements 3112 can be inserted through the plurality of holes 3111, respectively, to fasten in the first positioning holes 41 for positioning. The support plate 4 can further comprise a plurality of second positioning holes 42 formed on the bottom surface thereof and located aside the plurality of the first positioning holes 41, and a plurality of support elements 43 can be mounted on the bottom surface of the support plate 4, and each support element 43 comprises a plurality of first holes 431 cut through a surface thereof and aligned to the second positioning holes 42, respectively, and a plurality of screwing elements 4311 can be inserted through the plurality of first holes 431 to fasten in the plurality of second positioning holes 42, respectively. The support element 43 can include a second hole 432 formed between two adjacent first holes 431 and horizontally cut therethrough. In order to assemble the abutting plate 332 and the link rod 333, the link rod 333 can be sequentially inserted through the second holes 432 of the two support elements 43 first, to assemble the abutting plate 332, and the support element 43 can be used to support the linking device 33 of the adjusting device 3, so as to prevent the linking device 33 from being excessively shaken when the adjustable lifting support device is in use, thereby protecting the linking device 33 and improving endurability of the adjustable lifting support device of the present invention.

The placing plate 11 of the base 1 of the adjustable lifting support device of the present invention can be placed on desktop of a desk, an office desk or a meeting table, and the support plate 4 can be adjusted in position and height according to the user habit and comfort, and an electronic device, such as a notebook computer 5 or a tablet computer, can be placed on the support plate 4. In order to adjust the height of the support plate 4, the user can push upwardly the poke plate 334 of the linking device 33, so that the poke plate 334 can drive the horizontal section of the link rod 333 to rotate, and the abutting plate 332 can also be driven to rotate, and the longitudinal section of the abutting plate 332 is moved backwardly and simultaneously the joint rod 331 pushes the engaging member 32 of the adjusting device 3 backwardly; and, after the engaging member 32 is pushed to move by the joint rod 331, the engaging member 32 is rotated about the shaft part 321, so that the engaging surface 322 of the engaging member 32 can be separated from the plurality of teeth 22 of the lifting rod 2, and at the same time, the elastic element 325 are compressed and deformed by the accommodating groove 324 of the engaging member 32, and at this time, the user can upwardly or downwardly adjust the height of the support plate 4 according to the user's comfort in viewing or operating the electronic device. During the upward or downward movement of the support plate 4, the connecting holder 31 of the adjusting device 3 can also be driven to slide upwardly or downwardly along the rod 21 of the lifting rod 2 through the sliding hole 310.

After the user adjusts the support plate 4 to an adequate position, the user can stop applying force on the poke plate 334 of the linking device 33, so that the elastic element 325 at a side of the engaging member 32 can push outwardly by the elastic restoring force thereof, and the engaging member 32 rotates about the shaft part 321 and the engaging surface 322 can be engaged with the plurality of teeth 22 of the lifting rod 2 for stably positioning; and, the abutting part 323 of the engaging member 32 are rotated back, and the other components of the linking device 33 are also moved back simultaneously, so that the poke plate 334 of the linking device 33 is moved to the original position thereof, and the poke plate 334 can be pressed again to adjust the height of the support plate 4. The usage operation of the adjustable lifting support device of the present invention is completed.

The adjustable lifting support device of the present invention has advantages below.

First, the placing plate 11 of the base 1 of the adjustable lifting support device can be placed on desktop of a desk, an office desk or a meeting table, and the position of the placing plate 11 can be adjusted according to the focal length and comfort of the user eye, and the adjusting device 3 uses the linking device 33 to drive the engaging member 32 of the adjusting device 3 to engage with or separate from the plurality of teeth 22 of the lifting rod 2, so that the connecting holder 31 of the adjusting device 3 can be slidably lifted and locked on the rod 21 of the lifting rod 2. As a result, the horizontal height of the lifting support device can be precisely adjusted according to the user's view angle, thereby reducing burden on and injury in the user's shoulder and neck caused by incorrect posture.

Secondly, after the rod 21 of the lifting rod 2 is positioned on the connecting part 12 of the base 1, the support surface 122 of the back side of the combination groove 120 of the combination holder 121 is inclined, so the back side of the rod 21 can be abutted against the inclined support surface 122, and the rod 21 of the lifting rod 2 is inclined during the assembly process; as a result, during the process of slidably lifting the connecting holder 31 of the adjusting device 3 along the rod 21 of the lifting rod 2, the rod 21 of the inclined lifting rod 2 can provided resistance to prevent the connecting holder 31 of the adjusting device 3 from falling directly and quickly, so that the user can lift the connecting holder 31 of the adjusting device 3 effortlessly, thereby achieving the simple, time saving and more effortless operation.

Thirdly, the abutting part 323 of the engaging member 32 can include the accommodating groove 324 recessed on an opposite side thereof, the elastic element 325 can be accommodated in the accommodating groove 324, and the two ends of the elastic element 325 are abutted between the accommodating groove 324 and the connecting holder 31 of the adjusting device 3, so that the engagement force of the engaging member 32 of the adjusting device 3 engaging with the plurality of teeth 22 of the lifting rod 2 can be improved by the elastic function of the elastic element 325, to prevent the engaging member 32 from being separated from the plurality of plurality of teeth 22 easily. Furthermore, the elastic function of the elastic element 325 can also facilitate the user to operate the linking device 33 of the adjusting device 3 by single hand, thereby achieving the effect of improving engagement intensity and providing simple and convenient operation.

The present invention disclosed herein has been described by means of specific embodiments. However, numerous modifications, variations and enhancements can be made thereto by those skilled in the art without departing from the spirit and scope of the disclosure set forth in the claims.

What is claimed is:

1. An adjustable lifting support device comprising:

a base comprising a placing plate, and a connecting part disposed on a surface of the placing plate;

a lifting rod comprising a rod disposed on the base, and the rod comprising a plurality of teeth arranged longitudinally on a side surface thereof, and the lifting rod comprising a positioning part disposed on a bottom thereof and combined on the connecting part;

an adjusting device comprising a connecting holder slidably disposed on the lifting rod, and the connecting holder comprises a sliding hole formed on a side of a surface thereof, passing therethrough longitudinally and configured for insertion of the rod, and a support part disposed on other side of the surface of the connecting holder, and a shaft part of an engaging member is pivotally connecting to the connecting holder, and the engaging member comprising an engaging surface formed at a side of the shaft part thereof and configured to engage the plurality of teeth, and an abutting part formed on other side of the shaft part thereof and jointed with a linking device configured to drive the engaging member to rotate, so as to make the plurality of teeth engage with or separate from the engaging surface;

wherein the connecting part of the base comprises a combination holder protruded on the surface of the placing plate, and the combination holder comprises a combination groove recessed inside thereof, and the lifting rod is disposed in the combination groove, and the combination groove comprises a support surface formed at a back sidewall thereof and outwardly inclined, and configured to support a back side of the rod.

2. The adjustable lifting support device according to claim 1, wherein the combination groove of the connecting part comprises a plurality of restraining pins protruded around a bottom surface thereof, and the rod of the lifting rod comprises an accommodation space formed inside thereof, and a plurality of restraining grooves are formed on an internal wall of the accommodation space and configured for insertion of the plurality of restraining pins.

3. The adjustable lifting support device according to claim 1, wherein the connecting part comprises a through hole formed on a front sidewall of the combination groove thereof, and a first fastening element is inserted through the through hole, and the positioning part of the lifting rod comprises a locking hole passing therethrough forwardly and located below the plurality of teeth, and configured to lock with the first fastening element.

4. The adjustable lifting support device according to claim 1, wherein the support part of the connecting holder comprises a plurality of holes passing through the surface of the connecting holder, and a plurality of second fastening elements are disposed inside the plurality of holes, respectively, and the support part of the connecting holder comprises a support plate disposed thereon, and the support plate comprises a plurality of first positioning holes recessed on a bottom surface thereof and aligned to the plurality of the holes, and configured to lock with the plurality of second fastening elements, respectively.

5. The adjustable lifting support device according to claim 4, wherein the support plate comprise a plurality of second positioning holes formed on a side of the bottom surface thereof where the plurality of first positioning holes are formed, and the support plate comprises a plurality of support elements disposed on a bottom surface thereof and configured to support on the linking device, and each of the plurality of support elements comprises a plurality of first holes passing through a surface thereof and aligned to the plurality of second positioning holes, and a plurality of screwing elements are inserted through the plurality of first holes and fastened in the plurality of second positioning holes, respectively.

6. The adjustable lifting support device according to claim 1, wherein the connecting holder of the adjusting device comprises a plurality of plates disposed inside thereof and arranged in interval, and each of the plurality of plates comprises a pass hole passing therethrough, and the plurality of pass holes are aligned to each other, and the shaft part of the engaging member comprises shafts disposed at two side thereof and horizontally pivotally connected into the two pass holes.

7. The adjustable lifting support device according to claim 6, wherein an accommodating space is formed between the plurality of plates thereof, and an abutting part of the engaging member has a plurality of joint plates forwardly inserted into the accommodating space, and the linking device has a joint rod disposed inside the accommodating space and pivotally connected to the plurality of joint plates, and other end of the joint rod is connected to a L-shaped abutting plate, and the horizontal section of the L-shaped abutting plate is connected to a link rod, and a poke plate is disposed on other end of the link rod.

8. The adjustable lifting support device according to claim 7, wherein each of the plurality of joint plates of the abutting part comprises a joint hole passing therethrough, and a third fastening element is inserted through the plurality of joint holes, and the joint rod of the linking device comprises first combination holes passing through two ends thereof, respectively, and the first combination hole of the end of the joint rod is aligned to the joint hole and the third fastening element is inserted through the aligned first combination hole to pivotally connect to the joint rod integrally;

wherein the abutting plate comprises second combination holes formed on two ends thereof, respectively, and the second combination hole of a longitudinal section of the abutting plate is aligned to the first combination hole of the other end of the joint rod, and the fourth fastening element is inserted through the aligned first combination hole and the second combination hole, so as to fasten the joint rod and the abutting plate integrally;

wherein the link rod comprises a plurality of third combination holes passing through two ends thereof, the plurality of third combination holes of a horizontal section of the link rod are aligned to the plurality of second combination holes of a horizontal section of the abutting plate, respectively, and a plurality of fifth fastening elements are fastened into the aligned second combination holes and the third combination holes, respectively, so as to fasten the abutting plate with the link rod;

wherein the poke plate comprises a plurality of fourth combination holes recessed thereon and aligned to the plurality of third combination holes, and a plurality of sixth fastening elements are fastened into the aligned third combination holes and the fourth combination holes, so as to fasten the poke plate with the link rod.

9. The adjustable lifting support device according to claim 1, wherein the interval between the adjacent two tips of the plurality of teeth is in range of 0.5 cm to 5 cm.

10. The adjustable lifting support device according to claim 9, wherein the interval between the adjacent two tips of the plurality of teeth is 2 cm.

11. The adjustable lifting support device according to claim 1, wherein the abutting part of the engaging member comprises an accommodating groove recessed on an opposite side thereof, and an elastic element is accommodated in the accommodating groove, and two ends of the elastic element are abutted against between the bottom surface of the accommodating groove and the connecting holder.

* * * * *